US007971508B2

(12) United States Patent
Kozak

(10) Patent No.: US 7,971,508 B2
(45) Date of Patent: Jul. 5, 2011

(54) DEVICE TO EXTRACT BROKEN FASTENERS EMBEDDED IN A WORKPIECE

(76) Inventor: Ira M. Kozak, Riverwoods, IL (US)

( * ) Notice: Subject to any disclaimer, the term of this patent is extended or adjusted under 35 U.S.C. 154(b) by 168 days.

(21) Appl. No.: 11/805,565

(22) Filed: May 23, 2007

(65) Prior Publication Data

US 2009/0100973 A1 Apr. 23, 2009

Related U.S. Application Data

(63) Continuation-in-part of application No. 11/085,437, filed on Mar. 21, 2005, now abandoned, which is a continuation-in-part of application No. 10/365,334, filed on Feb. 12, 2003, now Pat. No. 6,868,756.

(51) Int. Cl.
*B25B 13/48* (2006.01)
*B25B 23/10* (2006.01)

(52) U.S. Cl. ..... 81/53.2; 81/441

(58) Field of Classification Search ..... 81/53.2, 81/441, 121.1, 451, 124.2, 436–438
See application file for complete search history.

(56) References Cited

U.S. PATENT DOCUMENTS

| | | | | | |
|---|---|---|---|---|---|
| 1,458,076 | A | * | 6/1923 | Potts | 81/441 |
| 1,683,796 | A | * | 9/1928 | Pearce | 81/53.2 |
| 1,815,500 | A | * | 7/1931 | Doan | 81/53.2 |
| 2,013,923 | A | * | 9/1935 | Naccarato | 81/441 |
| 2,497,214 | A | * | 2/1950 | Dreyer | 81/53.2 |
| 2,694,328 | A | * | 11/1954 | Lafreniere | 81/53.2 |
| 3,604,488 | A | * | 9/1971 | Wishart et al. | 81/451 |
| 3,727,491 | A | * | 4/1973 | Buckwalter | 81/53.2 |
| 3,735,650 | A | * | 5/1973 | Weng, Jr. | 81/53.2 |
| 4,078,458 | A | * | 3/1978 | Berendzen | 81/441 |
| 4,389,913 | A | * | 6/1983 | Drouin et al. | 81/53.2 |
| 4,507,837 | A | * | 4/1985 | Hinkle | 29/262 |
| 4,651,596 | A | * | 3/1987 | Rachanski | 81/53.2 |
| 5,649,791 | A | * | 7/1997 | Connolly | 408/1 R |
| 6,047,620 | A | * | 4/2000 | Kozak et al. | 81/441 |
| 6,997,086 | B1 | * | 2/2006 | Graham | 81/451 |

* cited by examiner

*Primary Examiner* — Hadi Shakeri

(57) ABSTRACT

A device to extract a fastener from a workpiece. The device includes a shaft having first and second end portions and, a cutting end tool adapted to engage and bore into the fastener as the shaft is rotated, a drill bit portion proximal to the cutting end tool and adapted to engage and bore into the fastener, and a socket disposed about the shaft and a collet collar disposed about the socket.

24 Claims, 15 Drawing Sheets

DEVICE TO EXTRACT BROKEN FASTENERS EMBEDDED IN A WORKPIECE

This is a Continuation-In-Part Application of application Ser. No. 11/085,437 filed on Mar. 21, 2005 now abandoned, which is a Continuation-In-Part Application of application Ser. No. 10/365,334 filed on Feb. 12, 2003, which issued as U.S. Pat. No. 6,868,756.

BACKGROUND OF THE INVENTION

1. Field of the Invention

The present invention relates to the field of tools for removing broken or frozen fasteners from a workpiece and, more particularly, to devices that remove rotary fasteners by applying a torque in a direction opposite to that initially necessary to drive the fastener into the workpiece.

2. Background of the Invention

To extract a broken fastener embedded in a workpiece, one often begins with a device to rotatably engage the head of the fastener. Other tools forcibly pull out or bore out the fastener.

Devices currently exist to extract head-less screws and other broken fasteners still embedded in a workpiece. Typically these devices include drilling tools that bore into the fastener. See U.S. Pat. No. 6,081,983 awarded to Hogson, et al. (2000), U.S. Pat. No. 5,546,834 awarded to Gable et al (1996), U.S. Pat. No. 5,544,987 awarded to Gipson (1996) U.S. Pat. No. 5,279,187 awarded to Salmon (1994).

As the tool bores into the fastener, it is hoped that the largest portion of the applied torque imparts a fastener-extracting force to the fastener. However, in actuality a large portion of the torque results in the tool being forced further into the fastener and the workpiece. This further penetration into the workpiece does not necessarily facilitate eventual extraction of the fastener but instead may result in damage to the workpiece.

There are devices that comprise a left handed cutting tool at one end and a left handed drill bit at the other. See for instance U.S. Pat. No. 5,031,487 awarded to Polonsky on Jul. 16, 1991. These devices have several disadvantages, including: (a) the necessity for manual handling of the device when switching from use of the cutter to use of the drill bit; (b) exerting a torque along the axis of the fastener rather than exerting a torque on the fastener's periphery—the best arrangement being the simultaneous exertion of a torque along the axis and on the periphery; and (c) the difficulty of finding a point where a power tool may grip the device. Another disadvantage in the prior art is that there is insufficient control of the direction in which the device acts. Sudden changes in the resistance offered to the tool result in changes in the direction in which the tool bores into the fastener or applies an extracting torque thereto.

A need exists in the art for a device to remove broken fasteners from a workpiece that would maximize the amount of torque that is applied to the fastener and ensure rapid, smooth, and safe operation. The device should combine the application of torque along the periphery of the fastener with application of torque at the longitudinal axis of the fastener.

SUMMARY OF THE INVENTION

It is an object of the present invention to provide a device to remove broken or frozen fasteners from a workpiece that overcomes many of the disadvantages of the prior art.

It is a further object of the present invention to provide a device to remove broken fasteners from a workpiece that maximizes the amount of torque that may be applied to remove a fastener. A feature of an embodiment of the invention is a drill-bit/cutting-tool surrounded by a socket which abuts against the fastener-workpiece interface and which may be used to apply torque to the periphery of the fastener. An advantage of the present invention is that at a given point the socket prevents further penetration of the device into the workpiece at the same time as it allows penetration of the drill bit portion of the device into the shank of the fastener thus imparting torque to an interior portion of the fastener shank. The result is that a large portion of the torque imparted to the device is used for the extraction of the fastener.

Another object of the present invention is to provide a device to remove broken fasteners from a workpiece that operates reliably. A feature of the present invention is an axially symmetric socket that abuts against the workpiece at a certain distance from where the device engages the fastener. Longitudinally extending portions of the socket may be cylindrical or conical (the latter to allow for fasteners with variable diameters). An advantage of the present invention is that it stabilizes the device in a direction perpendicular to the plane defining the fastener-workpiece interface.

Still another object of the present invention is to provide a device to remove broken right-hand (i.e. clockwise) fasteners from a workpiece that allows the convenient successive use of a left handed cutting tool and a left handed drill bit. It is a feature of the present invention that it comprises a shaft terminated by a left handed cutting tool which is integrally molded, or otherwise in communication with, a left handed drill bit. The reverse of this configuration is utilized to extract a left-handed fastener. An advantage of the present invention is that the drill bit is engaged during or after the cutting tool's action is completed without the need for any different movements or implements required by the user.

A further object of the present invention is to provide a method to remove broken fasteners from a workpiece that allows applying torque to the periphery of the fastener at the same time as torque is applied in the interior of the fastener. A feature of the present method is that it provides cutting action in a pre-determined direction of rotation, followed by, or simultaneous with, drilling action in the same pre-determined direction. Extracting torque is applied to the interior of the fastener while a socket rotational torque is applied to the exterior of the fastener. An advantage of the present invention is that two different portions of the fastener are acted upon to facilitate its extraction.

Yet a further object of the present invention is to provide a device to remove broken fasteners from a workpiece that allows cutting of the workpiece around the periphery of the fastener at the same time as torque is applied directly to the shank of the fastener. A feature of the present invention is a rotating elongated member terminating at a first end with a left handed cutting tool, the latter in communication with a proximally-located left handed drill bit. An advantage of the invention is that once in contact with the workpiece, the cutting tool confines the bit to a predetermined orientation relative to the workpiece while simultaneously isolating the bit within the confines of the cutting tool so as to prevent injury to the user.

Briefly, the invention provides a device to remove a fastener from a workpiece, the device comprising a rotatable shaft with a left handed cutting tool followed by a left handed drill-bit adapted to engage and bore into the fastener as the shaft is rotated counterclockwise; and a socket coaxial with and attached to the shaft at a point between the drill-bit portion and the point where the shaft is rotated, with interior surfaces of said socket defining a cavity.

BRIEF DESCRIPTION OF THE DRAWING

The foregoing invention and its advantages may be readily appreciated from the following detailed description of the invention, when read in conjunction with the accompanying drawing in which.

DETAILED DESCRIPTION OF THE INVENTION

The present invention provides a device to remove broken fasteners from a workpiece. In general terms, the device comprises a drill used in cooperation with a socket to provide removing torque along different regions of a recalcitrant fastener. With suitable modifications, the device may be used to remove either right-handed or left-handed broken fasteners. The device can be either manually-driven or power-driven.

For the sake of simplicity, this description will emphasize the removal of right handed fasteners. However, left-handed fasteners also can be accommodated with the invented device configured with a right-handed cutting tool and a right-handed drill bit.

The present invention provides alternate means for fastener removal: In one configuration the fastener is removed without the socket penetrating into the workpiece in which the fastener is embedded. In another configuration the fastener is removed while the socket penetrates into the workpiece. The tool user has the option of using the non-penetrating configuration first and resorting to the second configuration when circumstances require it. An advantage of using a penetrating socket is that during fastener extraction, a smooth, circular score is made around the circumference of the fastener in the workpiece in a direction parallel to the fastener's longitudinal axis. When the fastener is finally extracted, the cavity defined by the score can be filled with a plug of the same (or different) material as the workpiece (wood, metal, plastic, etc . . .), thereby facilitating reassembly for a cosmetically pleasing result.

Figure 1A:
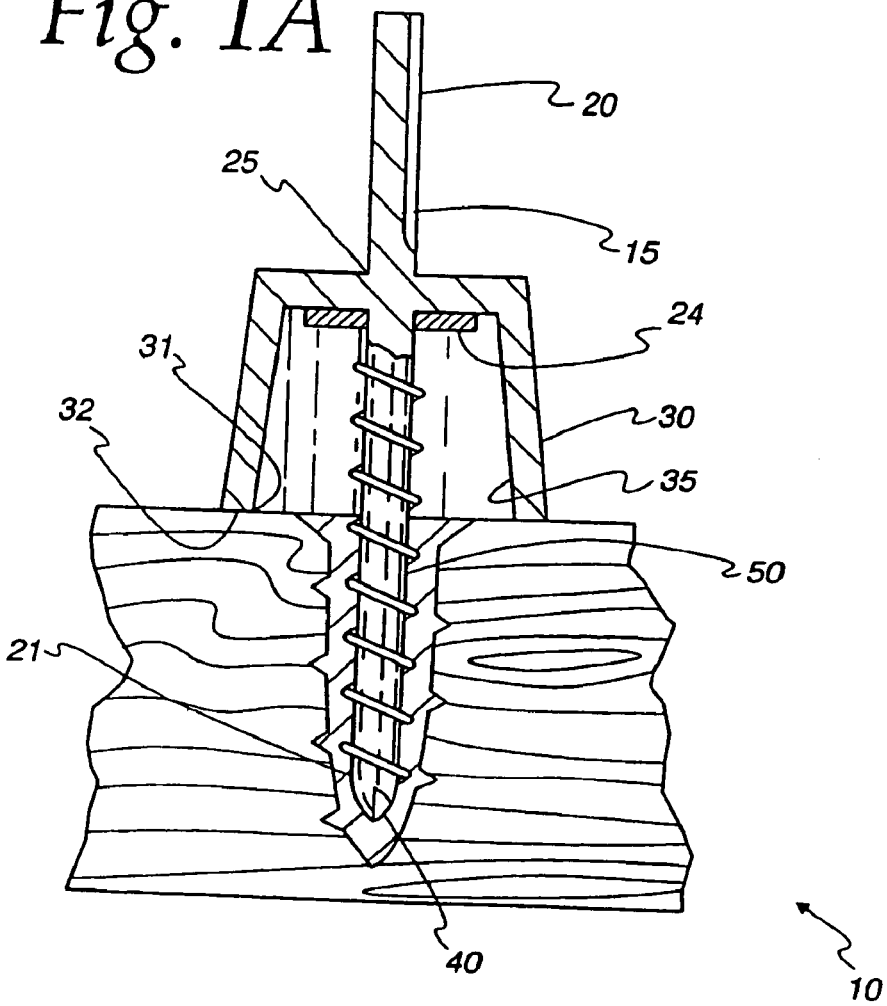
FIG. 1 A is a cross-sectional view of a first embodiment of a device for removing a fastener from a workpiece in accordance with features of the present invention.
FIG. 1B is a cross-sectional partial view of a detail of a first embodiment of a device to remove a fastener from a workpiece, in accordance with features of the present invention.

As shown in FIG. 1A, the invented device generally designated as 10, comprises a cylindrical shaft 15 with a first end 20 and a second end 21. The first end 20 is adapted to be received by a power-driven tool or a hand-actuated handle. As such, the cross-section of the first end 20 can be polygonal or circular, and can be further modified to define a key-way 22 to enhance gripping with a rotating chuck (not shown) or some other rotating means.

The second end 21 of the shaft is generally configured as a drill bit 50. The drill bit is shown embedded into a fastener 60.

A cylindrical or conical socket 30 is positioned coaxial with the shaft 15 and terminates in a rim 31 extending distally, i.e., in a direction opposite the first end 20 of the shaft. The socket can be a static object with no moving parts, rather only containing a polished surface to facilitate slipping over a workpiece or a serrated surface to effect cutting into the workpiece. Alternatively, the socket can be a collet adapted to threadably receive a constriction ring along an exterior surface of the collet.

Irrespective of the additional functionality of the cutting tool (the socket), the rim 31 of the socket generally defines a distally-facing surface 32 which, depending on the application, may be smooth (i.e., the polished surface noted supra), serrated, fluted, or provided with teeth.

Furthermore, and as discussed more fully below, and depicted in FIG. 4A, an inwardly facing surface 35 of the socket 30 may comprise ribs 33, flutes, or be otherwise configured to enhance its mechanical or frictional engagement with the periphery of a fastener's head.

Figure 1B:
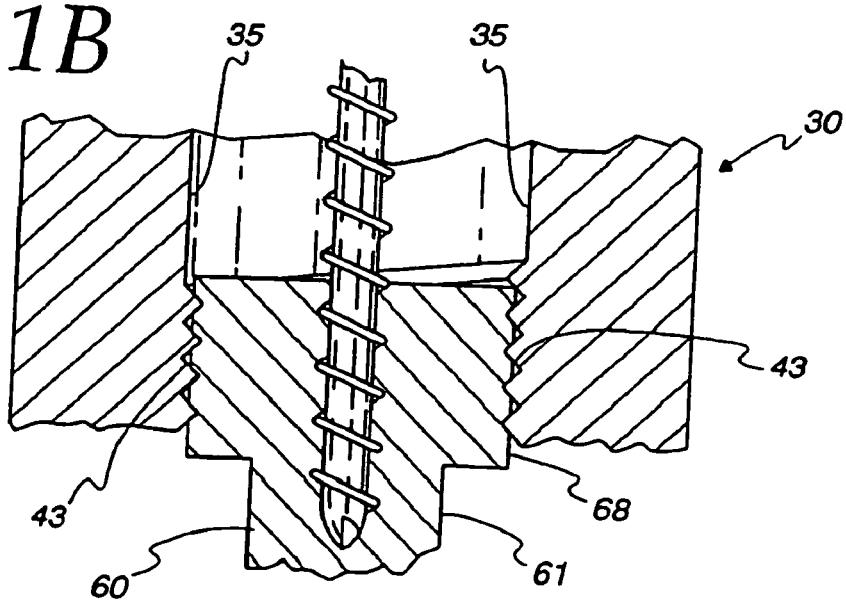

Also as shown in FIG. 1B, the inside surface 35 of the socket 30 may be configured as a die with a self-tapping thread 43 that enhances engagement between the socket 30 and either the head 68 or the shank 61 (if the head has been broken off of the fastener 60.

The socket communicates with the shaft 15 at a point 25 intermediate the first end 20 and second end 21 of the shaft. The socket 30 may be integrally molded (e.g. welded, casted, or forged) to the shaft, or reversibly connected thereto via a set screw or locking collar, or a male-female threaded configuration.

Figure 3A:
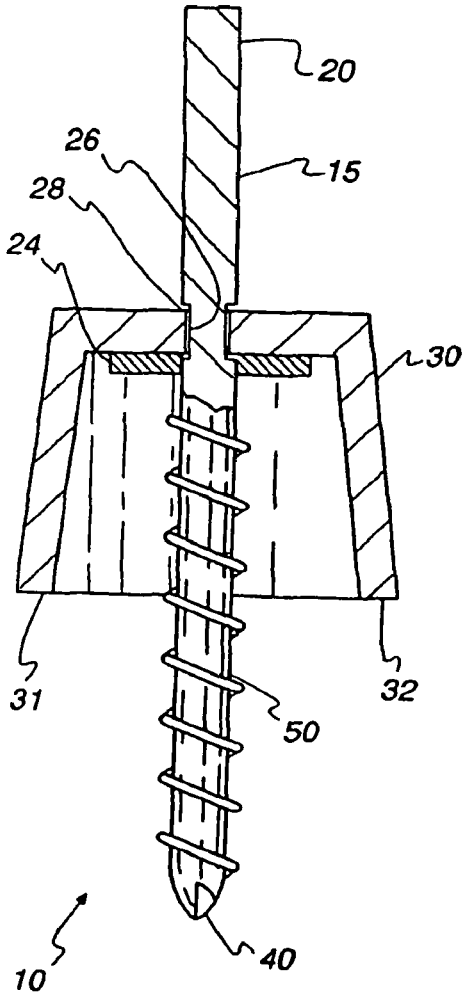
FIG. 3A is a cross-sectional view of a modified first embodiment of a device to remove a fastener from a workpiece, in accordance with features of the present invention.
Figure 3B:
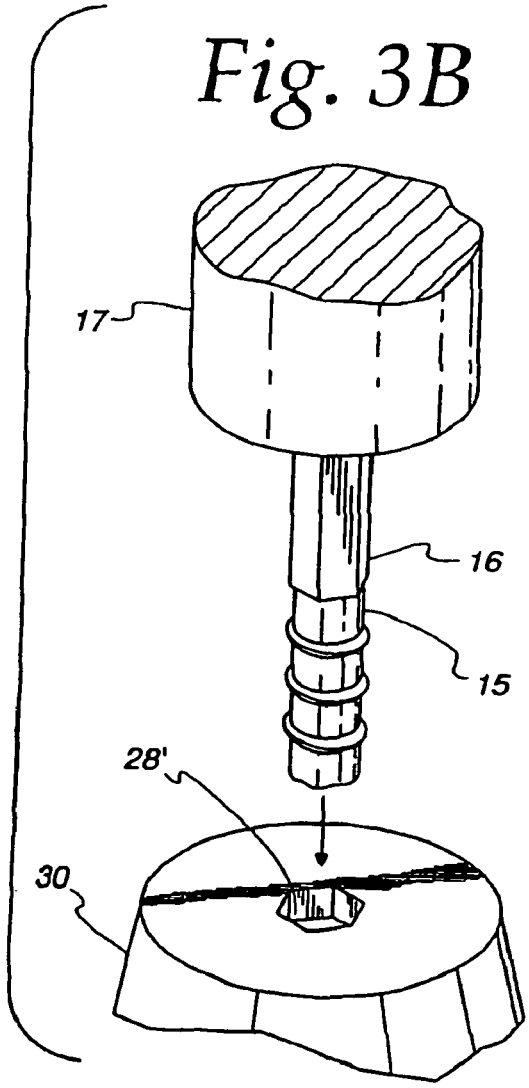
FIG. 3B is a cross-sectional view of a detail of a modified first embodiment of a device to remove a fastener from a workpiece, in accordance with features of the present invention.

Alternatively, and as shown in FIG. 3A, the socket may be retained between radially projecting portions or shoulders 17 of the shaft so as to allow free rotation of the shaft 15 with respect to the socket 30. A shoulder 17 on the shaft, external of the internal void defined by the socket, may be spring biased (via a spring situated intermediate the shoulder and the socket) so as to confer distally extending pressure to the socket. This allows motion of the socket along the axis while pressure is applied to the shaft. To assure simultaneous rotation of the shaft with the socket in this scenario, a cross section 16 of the shaft may be adapted to be received by a similarly configured aperture defined by a region on an upwardly facing surface of the socket. For example, and as depicted in 3B, a hexagonal cross section 16 of the shaft 15 is slidably received by a hexagonal shaped aperture 28' formed in a region of the socket. FIG. 3B shows a spring 80 intermediate the socket and the shoulder 17. It should be noted that the external shoulder 17 can either integrally molded to the shaft or else reversibly attached to the shaft via a ball-detent mechanism, a screw collar configuration, or similar collar attachment means.

Extending from the shaft 15 is a left handed drill bit portion 50 that terminates in a left handed cutting tool 40 (as noted supra, for the sake of illustration, it is assumed that the fastener to be removed is right handed). This drill bit can either be solid throughout (i.e., a typical drill bit) or the drill bit can define a hollow interior accessible from its tip (i.e., the location of the cutting tool 40). The hollow interior is adapted to slidably receive center pins typically found on commercially available security screws, also known as tamper resistant screws. The hollow bit encapsulates the pin as the bit bores through the pin shank for ultimate removal of the fastener.

Figure 2:
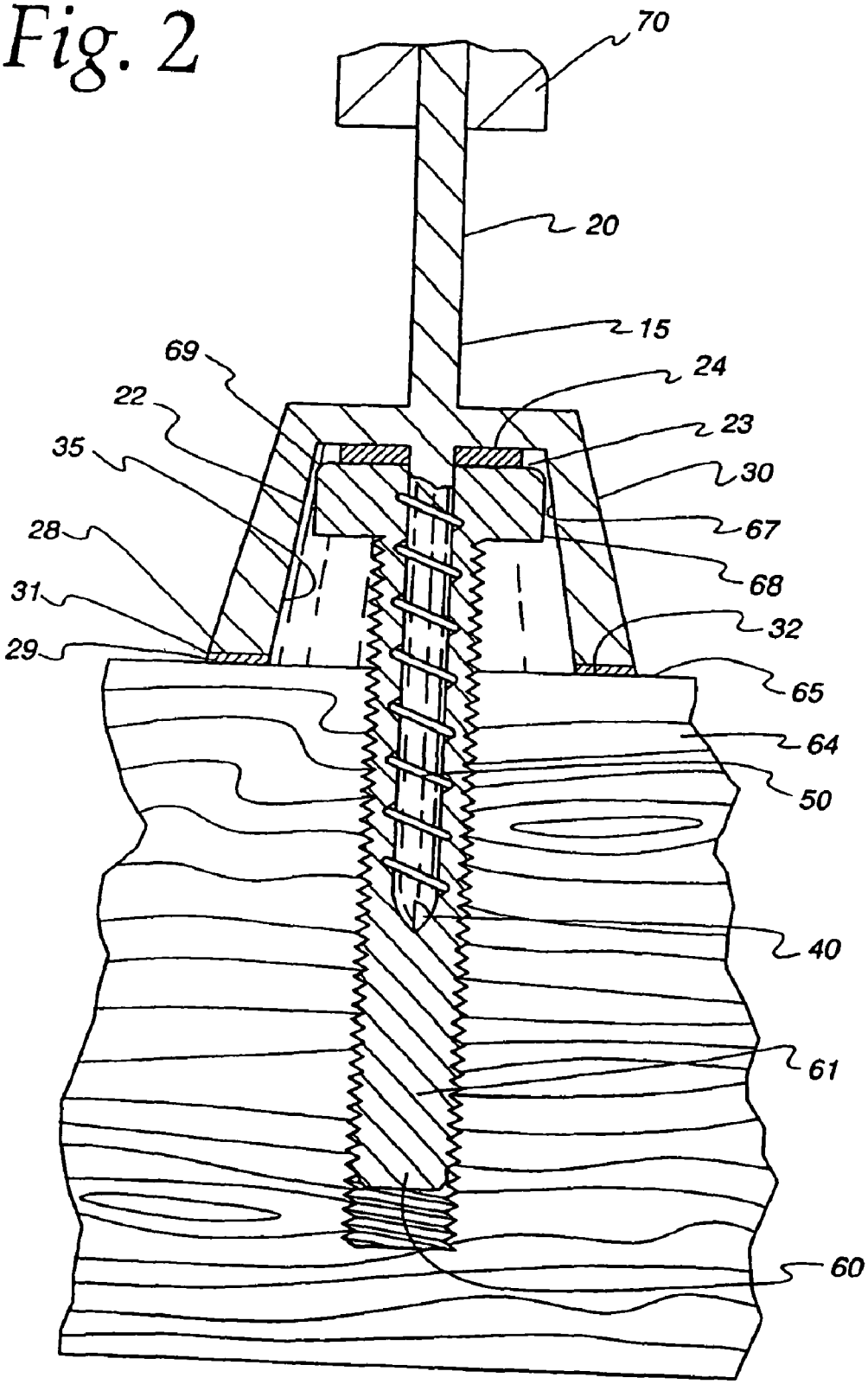
FIG. 2 is a cross-sectional view showing the use of a device removing a partially extracted fastener from a workpiece, in accordance with features of the present invention.

FIG. 2 illustrates how the device is used. FIG. 2 depicts the cutting tool 40 and the drill bit portion 50 having penetrated the fastener 60 deep enough for the surface 32 on the rim 31 of the socket 30 to abut or otherwise contact the surface 65 of the workpiece 64. Torque is provided by a rotating portion (such as a chuck) of the power tool 70. The first end 20 of the shaft 15 is adapted to be received by the power tool.

In the device depicted in FIG. 2, whereby the depending lip 32 of the socket has a smooth topography, the socket 30 prevents further penetration of the device 10 into the workpiece 64. Rather, the device rotates as the surface 32 slides on the workpiece surface 65, so that the drill bit 50 can penetrate further into the fastener 60 only as the fastener is extracted from the workpiece 64 towards the power tool 70. Frictional engagement between the fastener 60 and the bit 50 may be enhanced by the use of a tapping bit. This will confer additional extracting functionality whereby the bit would be able to impart upon the fastener an axial force by the user, as well as a rotational force.

Optionally, the sliding of the socket rim surface 32 over the workpiece surface 65 is facilitated by lining the rim surface 32 with a friction-reducing material 29 such as polytetrafluoroethylene (e.g. Teflon.®), by installing roller bearings on the rim surface, or by providing the rim surface 32 as a polished surface without sharp edges thereon. Optionally, a "radius" (i.e. an upward sloping section directed tangentially to the circular rim) on a leading edge of the socket rim would allow smooth socket travel over irregularities on the workpiece surface. As shown infra, the same low friction feature may be obtained by providing the socket with an annular aperture at the point where the socket communicates with the shaft so as to allow rotation of the shaft with respect to the socket. Again the socket aperture or the shaft may be lined at this point with friction-reducing materials.

As extraction of the fastener 60 proceeds, the fastener head 68 comes to rest against an interior surface 23 of the socket 30 at a point determined by the diameter of the fastener head 68. Optionally, regions of the interior surface 23 friction enhancing structures such as ribs, flutes, teeth, knurls, etc . . . A gasket or ring 24 consisting of a spring or of suitable pliable or reversibly deformable material in the interior surface 23 of the socket 30 may be used to provide a means for a rotating force to be exerted on top and/or periphery of the head 68 of the fastener via friction between the ring 24 and the fastener head 68 (or the shank 61 of the fastener 60, if the head 68 has been broken off). Alternatively, engagement of the socket with the head of the fastener may also be effected by having the socket define a conical inside surface 35 that is fashioned so as to grip the periphery of the head 68 or shank 61 of the fastener 60 once it reaches a point 67 on the inside surface of the socket. This can be accomplished by providing a rough friction enhancing surface that may include flutes or ribs 33 (see FIG. 4A) or other roughness imparting structures, on the inside surface 35 of the socket as noted supra.

An alternative means of juxtaposing the socket with the shaft is depicted in FIG. 3A. This configuration differs from the one shown in FIG. 1 in that the socket 30 is free to rotate azimuthally around the shaft 15. This is accomplished by providing a channel 26 about the circumference of the shaft adapted to receive medially directed portions 27 of the socket, said portions generally perpendicular to the longitudinal axis of the shaft and the socket. This axial rotation may be facilitated by juxtaposing a ball bearing-containing annulus intermediate the channel 26 and medially directed portions 27, or by lining the channel 26 with a friction-reducing material such as Teflon. In this configuration, the shaft is neither integrally formed with the socket or reversibly locked in axial rotation with the socket. Rather, the shaft is in rotatable communication with the socket. The socket is inserted through the first end 20 of the shaft 15 and prevented from moving back towards the first end 20 by means of a split ring inserted in the channel 26 or a set-screw held ring just above the channel 26, the latter taking the form of the reversibly-attached shoulder 17 discussed supra. This arrangement allows adjustment of the socket position along the shaft 15.

Figure 4A:
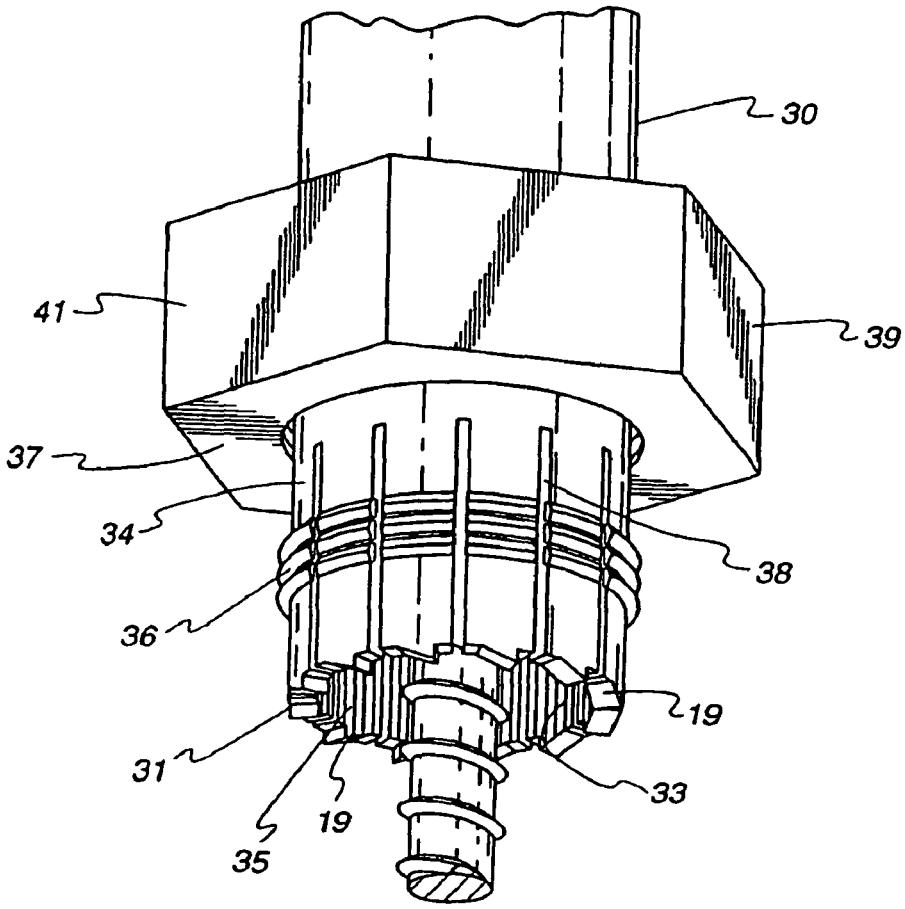
FIG. 4A is an elevational view of another embodiment of a device to remove a fastener from a workpiece in accordance with features of the present invention.

A second embodiment, shown in FIG. 4A differs from the one shown in FIG. 1 in that the socket 30 is specifically adapted to grip the periphery 69 of the head 68 of the fastener 60. The socket 30 is of a cylindrical shape with an inside surface 35 and an outer surface 34. The inside surface 35 has a diameter that complements the diameter of the periphery 69 of the head 68 of the fastener. The inside surface 35 comprises ribs 33 or other friction enhancing means designed so as to grip the periphery 69 of the head 68 of the fastener once the extraction of the fastener has begun (See FIG. 4B). Also, the outer surface 34 of the socket may have a rough, knurled or polygonal shape so as to allow application of torque thereto by means of a wrench when necessary.

As shown in FIG. 4A, the socket's gripping action may be enhanced by providing on the outer surface 34 a male-threaded section 36 designed to be received by a coaxial female-threaded collet collar 37 positioned on the socket 30. In this instance, longitudinally extending portions of the socket define one or a plurality of slits 38 which are parallel the longitudinal axis of the socket. The gripping action of the socket upon the peripheral region of the fastener head or shank is therefore enhanced as the collet collar is threaded onto the socket and advanced toward the workpiece. This collet-socket configuration also allows for an inside surface of the collet to define a cone, while the outside surface of the collet resembles a cylinder.

Figure 4B:
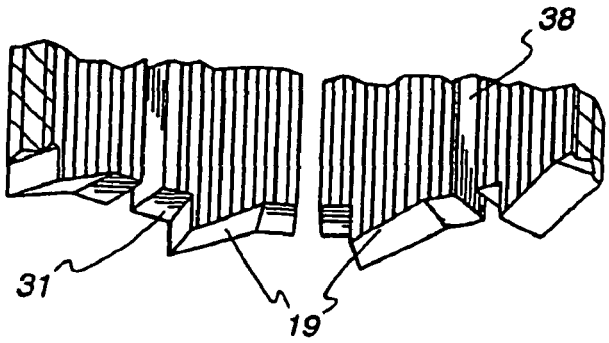
FIG. 4B is a detailed view of the rim of an embodiment of a device to remove a fastener from a workpiece in accordance with features of the present invention.
Figure 4C:
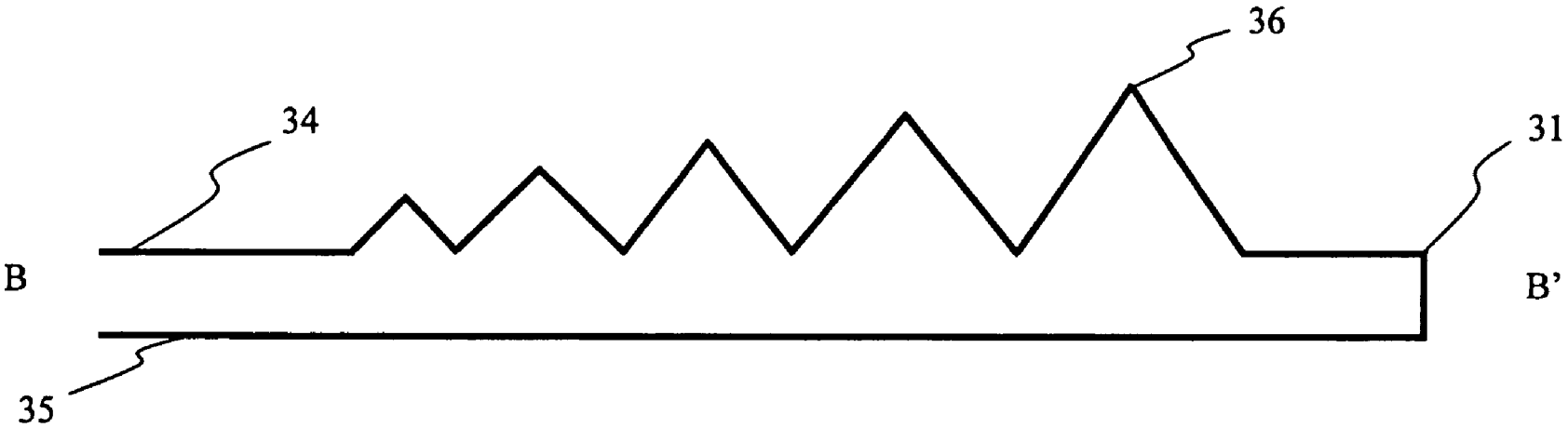
FIG. 4C is a detailed view of the surface of an embodiment of a device to remove a fastener from a workpiece in accordance with features of the present invention.
Figure 4D:
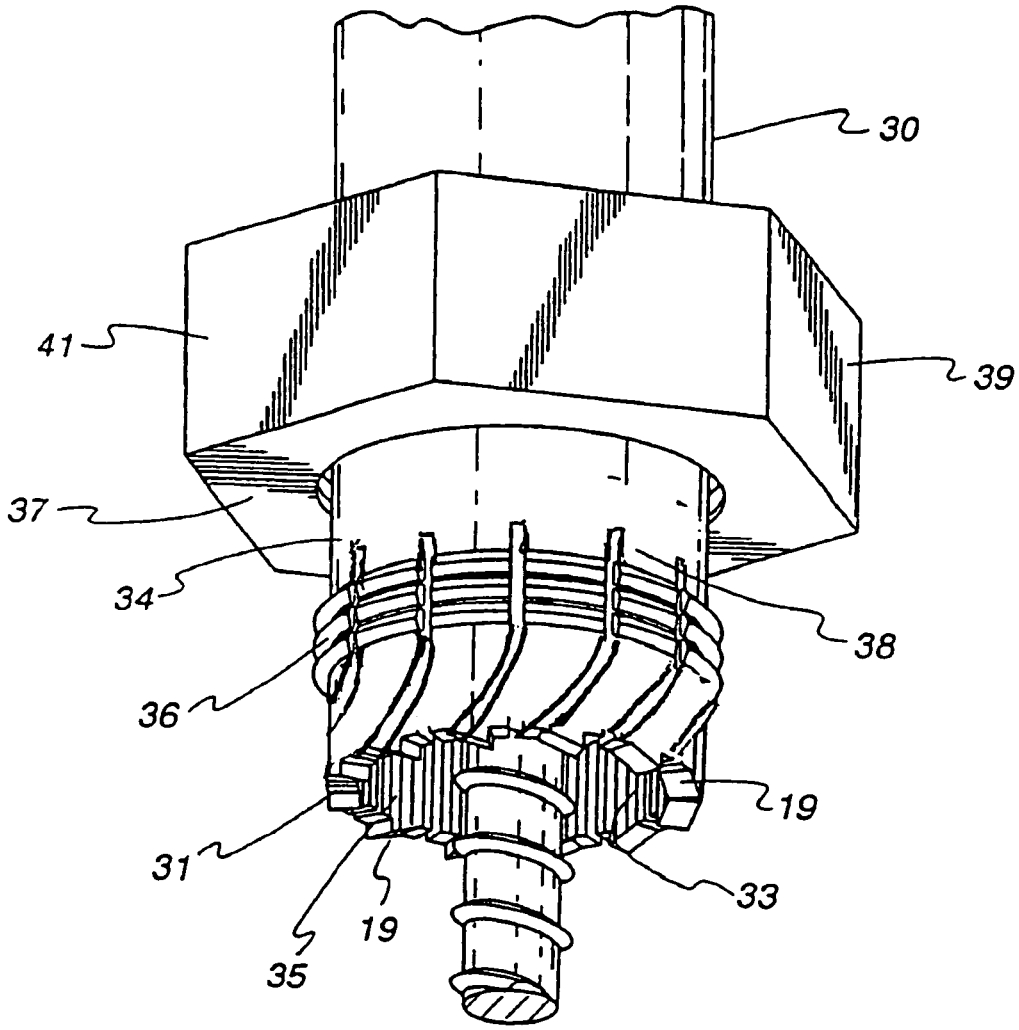
FIG. 4D is an elevational view of an alternate embodiment of a device to remove a fastener from a workpiece in accordance with features of the present invention.
Figure 4E:
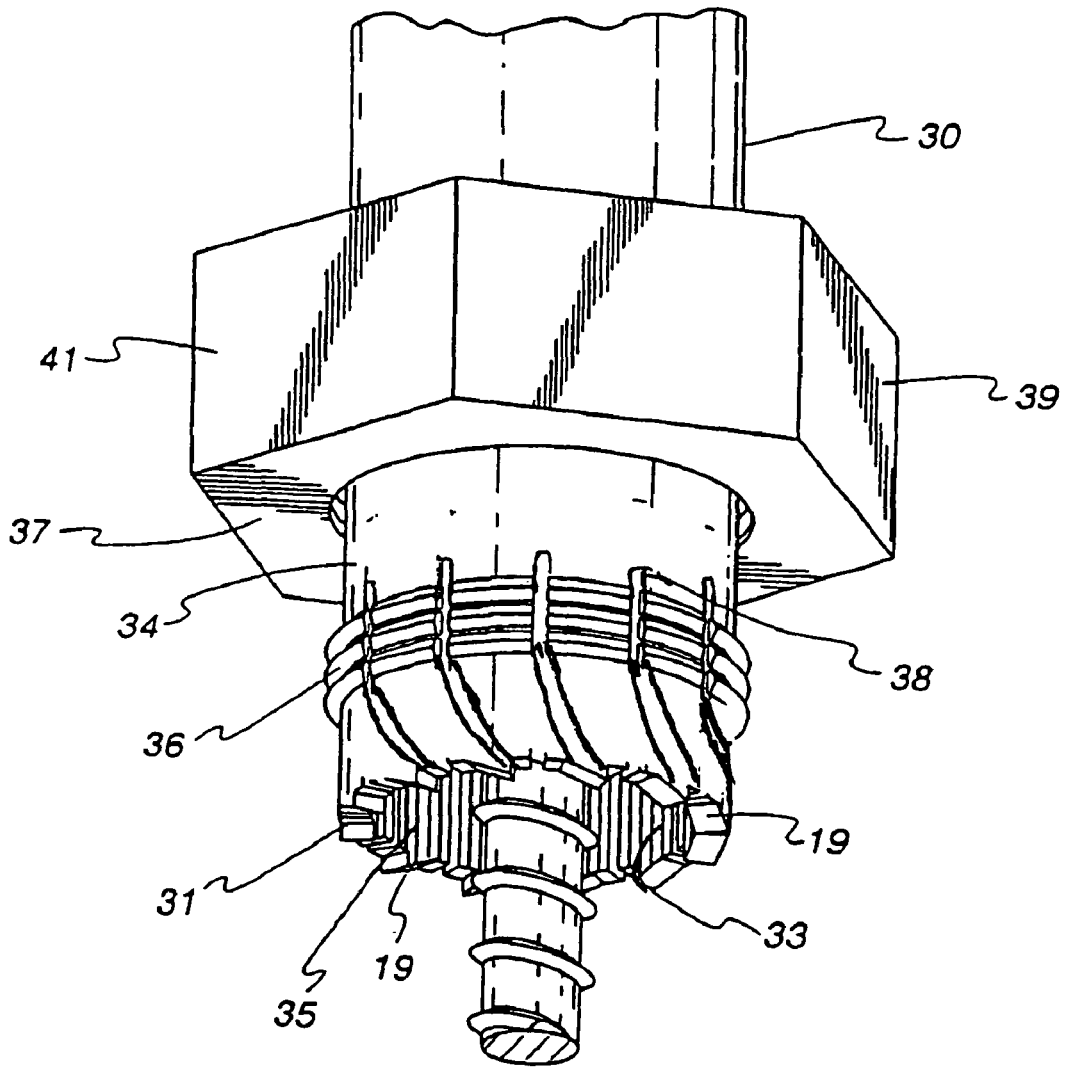
FIG. 4E is an elevational view of an alternate embodiment of a device to remove a fastener from a workpiece in accordance with features of the present invention.

The slits 38 in the socket 30 may extend rectilinearly parallel to the shaft 15 or assume right-handed or left-handed helical configurations (see FIGS. 4D and 4E). This rectilinearly parallel extension may continue partway along the socket surface and then deviate to a right-handed or left-handed helical configuration. The resiliency in the sockets-with-slits configurations may in and of itself provide sufficient engagement of the fastener head with the socket so as to make tightening of the collet unnecessary.

A particularly advantageous collet thread configuration is illustrated in FIG. 4C. FIG. 4C depicts a detail of a cross-sectional view along the line C-C of FIG. 4A showing a male-threaded section 36 wherein the height of the thread's protrusion above the surface 34 increases the closer the thread is to the rim 31 of the collet socket. In this configuration, advancing the collet collar 37 towards the rim 31 produces a narrowing of the slits 38 and a corresponding decrease in the diameter of the inside surface 35 of the socket 30.

FIG. 4A depicts a configuration where the collar 37 has a knurled outer surface or fluted surface 41 so that the collar 37 may be tightened by hand. Pliers, a wrench or some other tool may also be used, an operation that is facilitated if the outer surface 41 of the collet collar 37 comprises rectangular faces 39 in the form of a hexagonal nut, or some other grip-friendly topography.

Where it is not necessary to avoid cutting into the workpiece, a socket that cuts into the workpiece offers distinct advantages. This is the case for both of the above socket embodiments, but especially so for the fastener gripping embodiment. This is shown in FIG. 4B where the socket rim 31 comprises left handed cutting teeth 19.

Single socket-size configurations have been described supra. But it may be desirable to be able to remove, replace, or interchange the sockets. Removable-socket arrangements have been described supra. Other possible means of attachment is for the socket 30 to define a female left-hand-threaded aperture that is threaded upon a matching male threaded section of the shaft 15. In yet another method for attaching the socket, the socket defines a hexagonal (or other polygonal) opening 28' that may slidably accept a matching portion 16 of the shaft 15 until the socket comes to abut the shoulder 17 which may be integrally molded with the shaft or held in place by a set screw 81. (See FIG. 3B). The socket may be held in place by a set screw, a ball detent mechanism, or a force along the axis applied by the user. One advantage of a temporary attachment for the socket is that it allows first the use of the first embodiment of the invention, where the socket is used to apply pressure to the workpiece until a sufficient portion of the fastener is extracted and then that socket is replaced with a fastener gripping socket such as a conical socket or a collet described supra. This allows the user to take advantage of the features of both embodiments. Interchange of sockets is facilitated when provision is made for the shaft to be inserted into the socket via the first end 20 (so that socket exchange may be accomplished while the drill bit portion 50 of the device is simultaneously engaged with the fastener), in which case provision must be made for a firm attachment of the socket to the shaft. More importantly, inasmuch as the second or "fastener gripping" embodiment requires that the socket inner diameter exceed but very slightly the diameter of the fastener head, operators of the invented device may satisfy multiple needs with a kit comprising only one cutting tool/drill bit shaft together with an assortment of sockets of different inner diameters and different surface configurations.

A variety of materials are suitable for the drill bit portion of the invented device. The requirements are slightly different from those for ordinary cutting tools and bits in that here greater friction between the drill bit device and the surrounding fastener material is required.

Thus the use of a high grade carbide steel drill is not always necessary. One possible embodiment is one where the drill bit portion 50 is tapered. Another possible embodiment would comprise a tapping drill bit.

Referring now to FIGS. 5-12, an alternative device 100 to extract a fastener 102 from a workpiece 104 in accordance with the present invention is depicted. The device 100 includes a shaft 106 having first and second end portions 108 and 110. The first end portion 108 is adapted to removably receive a motorized rotary drive tool (not depicted) for imparting rotary motion contrary to the direction of rotation of the fastener 102 into the workpiece 104. The second end portion 110 includes a cutting end tool 112 adapted to engage and bore into the fastener 102 as the shaft 106 is rotated, the shaft 106 rotation resulting from the urging of the rotary drive tool. The second end portion 110 further includes a drill bit portion 114 proximal to the cutting end tool 112 and adapted to engage and bore into or penetrate the fastener 102 as the shaft 106 is rotated. Cutting threads 116 are disposed upon the second end portion 110 between the drill bit portion 114 and the first end portion 108. The cutting threads 116 form a cutting portion 118 that engages and cuts into a wall formed from the drill bit portion 114 penetrating the fastener. The cutting threads 116 penetrate the fastener 102 a predetermined distance while the drill bit portion 114 bores into the fastener 102 whereby the cutting threads 116 secure the device 100 to the fastener 102 and promote the rotation of the fastener 102 contrary to the fastener's 102 direction of rotational engagement to ultimately remove the fastener 102 from the workpiece 104.

Figure 5:
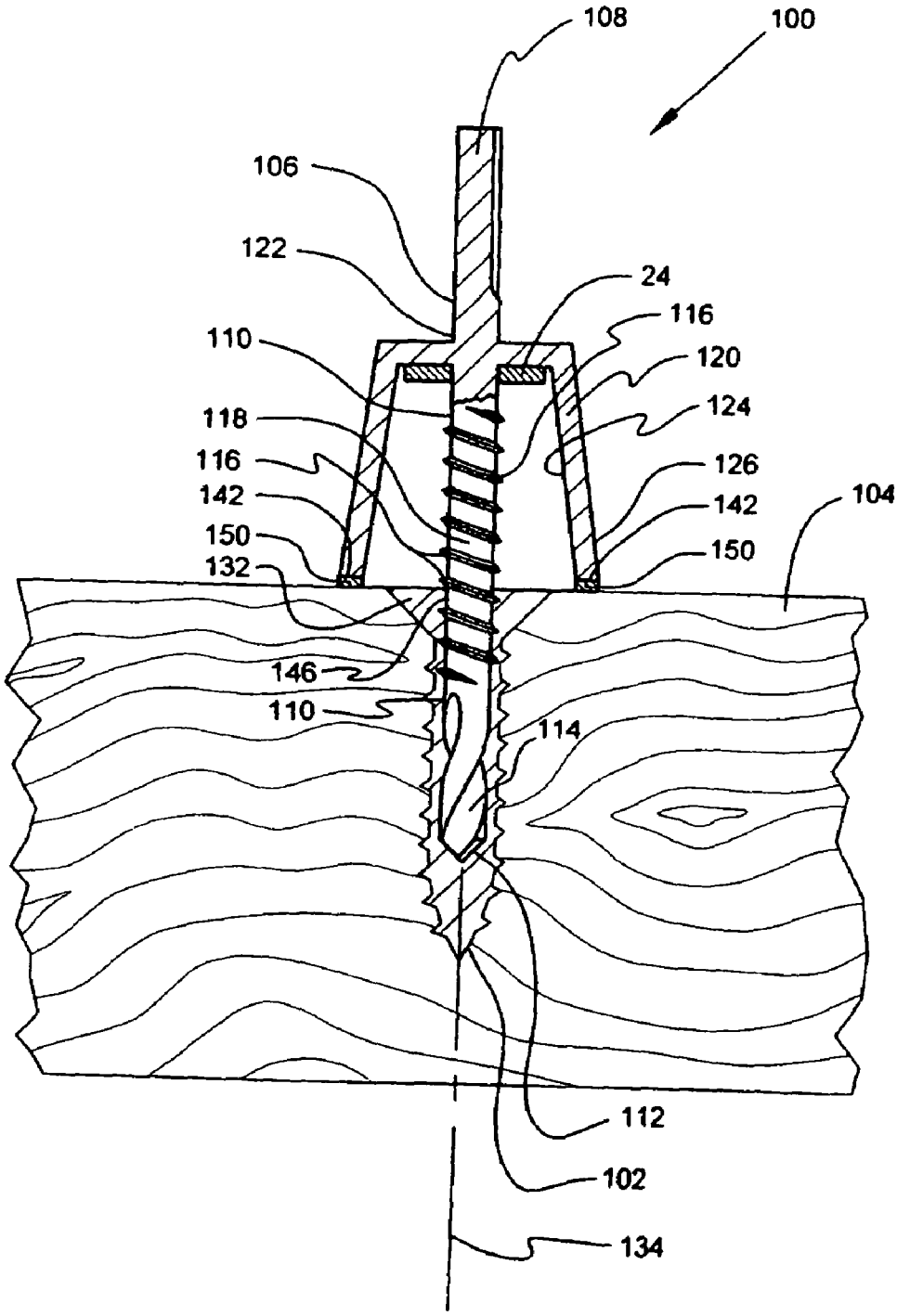
FIG. 5 is a front partial sectional elevation view of an alternative device engaging a flat head fastener in a workpiece in accordance with the present invention.
Figure 6:
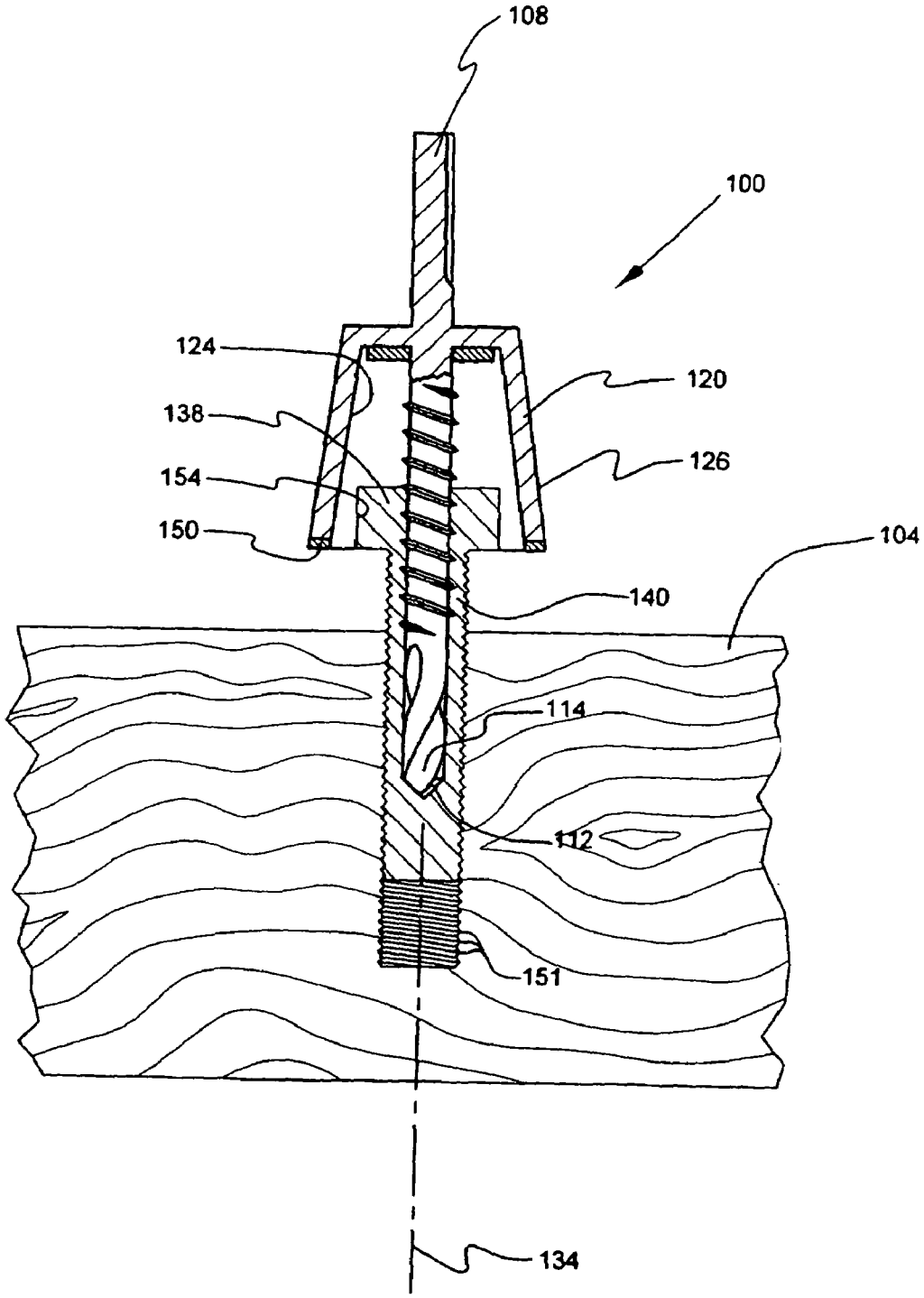
FIG. 6 depicts the alternative device of FIG. 5 extracting a hexagonal head fastener from a workpiece in accordance with the present invention.
Figure 7:
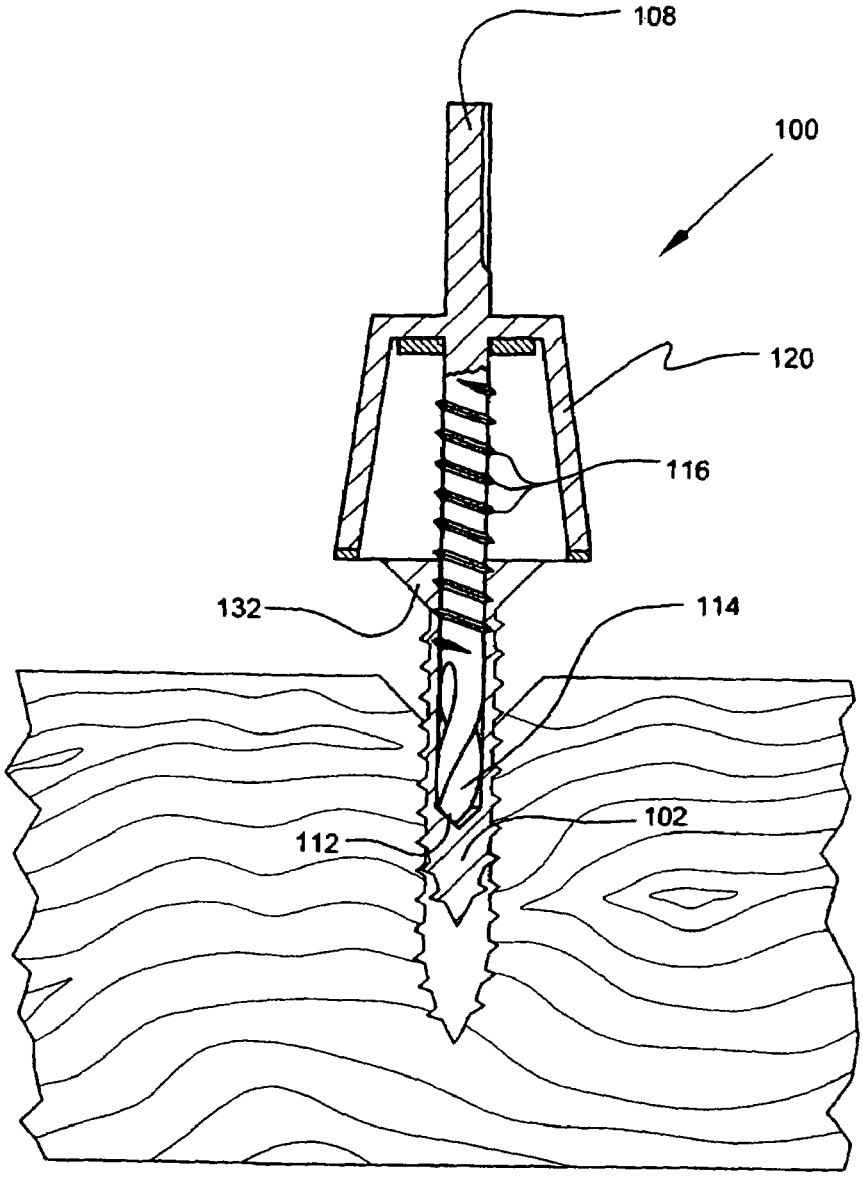
FIG. 7 depicts the alternative device of FIG. 5 extracting the flat head fastener from the workpiece.
Figure 8:
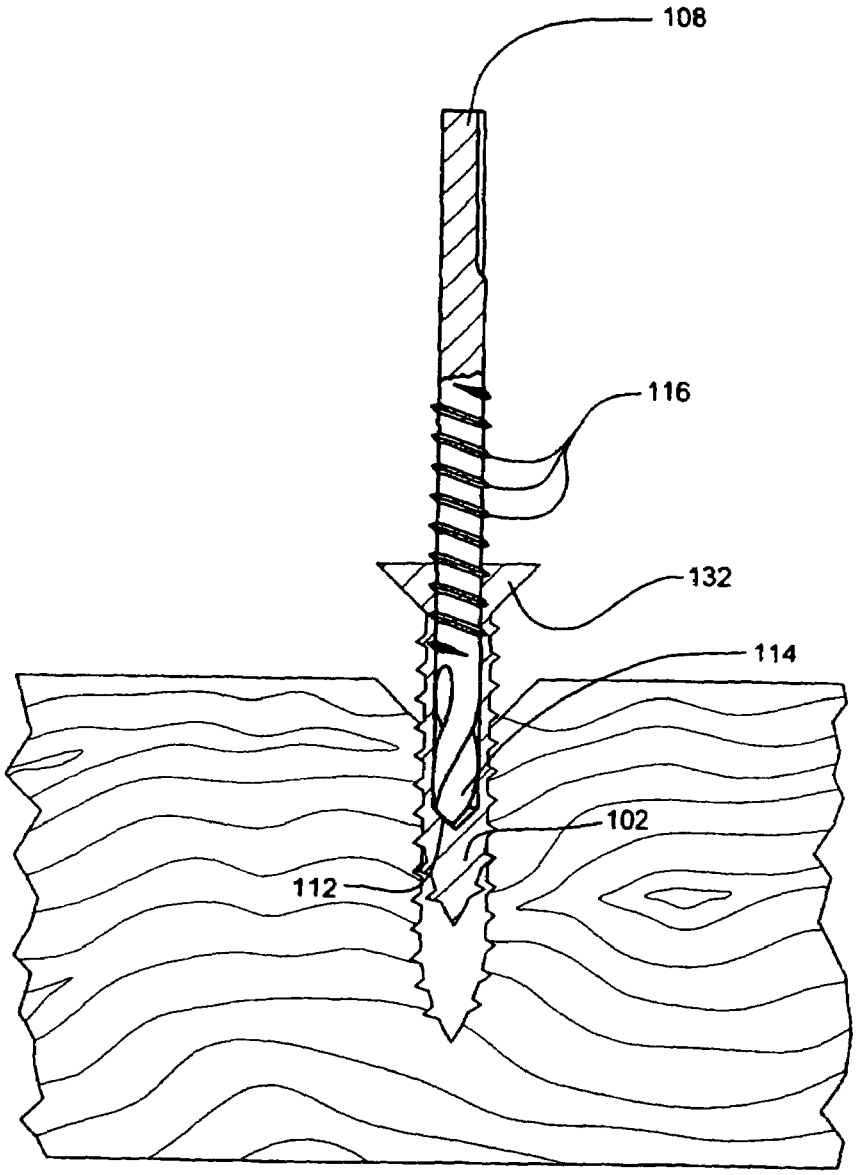
FIG. 8 depicts the device of FIG. 7 in accordance with the present invention, but without a socket secured to a shaft.
Figure 9:
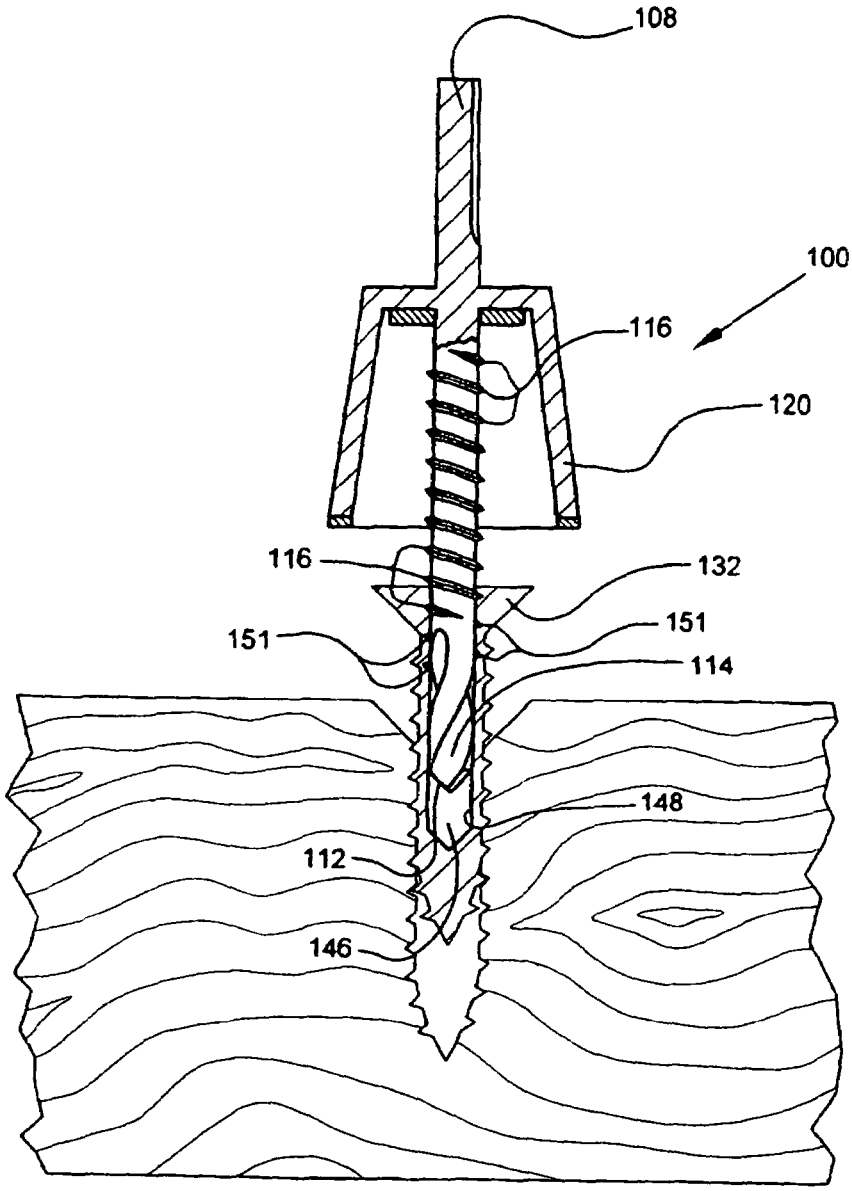
FIG. 9 depicts the alternative device of FIG. 7, but with a recess in the fastener.
Figure 10:
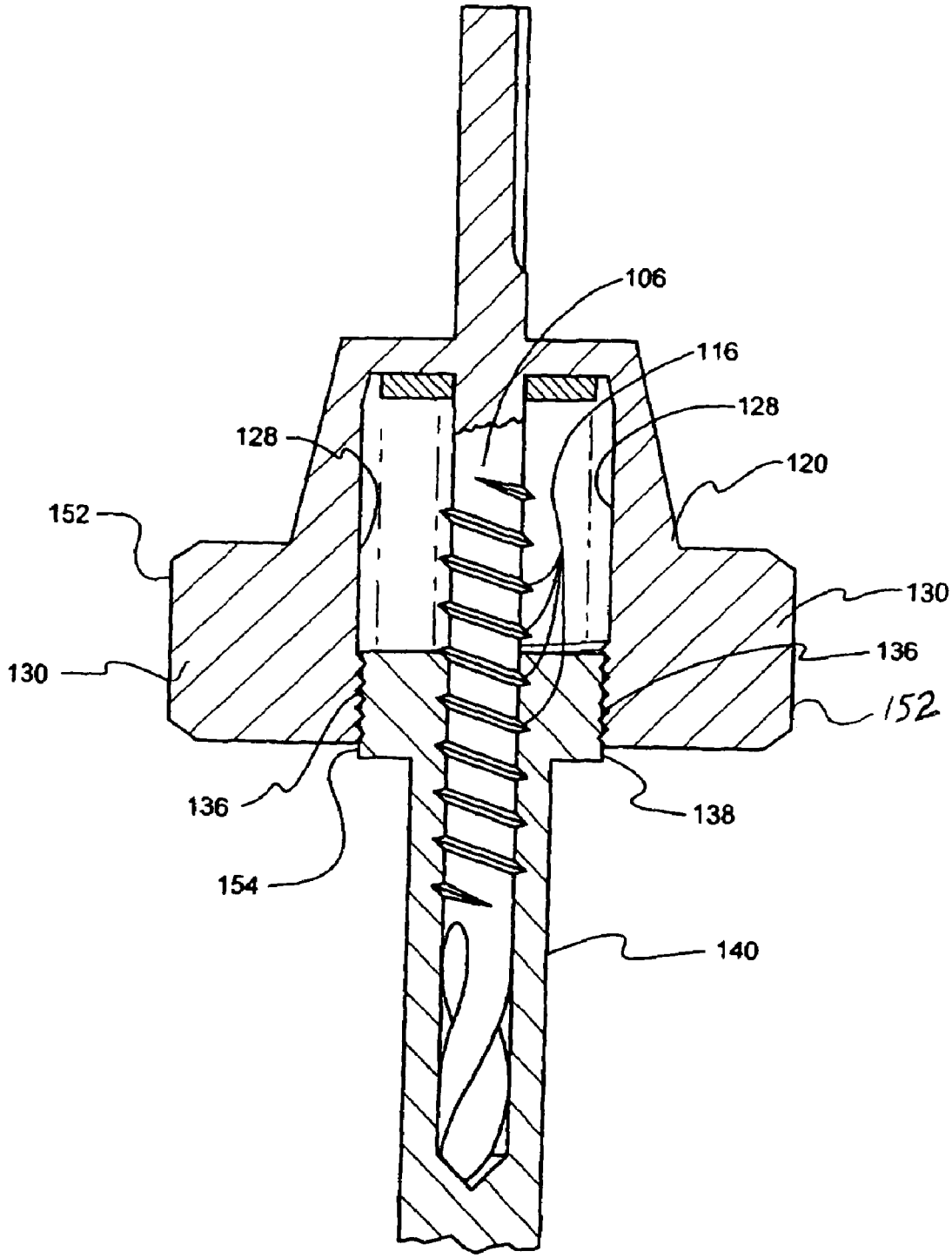
FIG. 10 depicts the alternative device of FIG. 6, but with a modified socket in accordance with the present invention.
Figure 11:
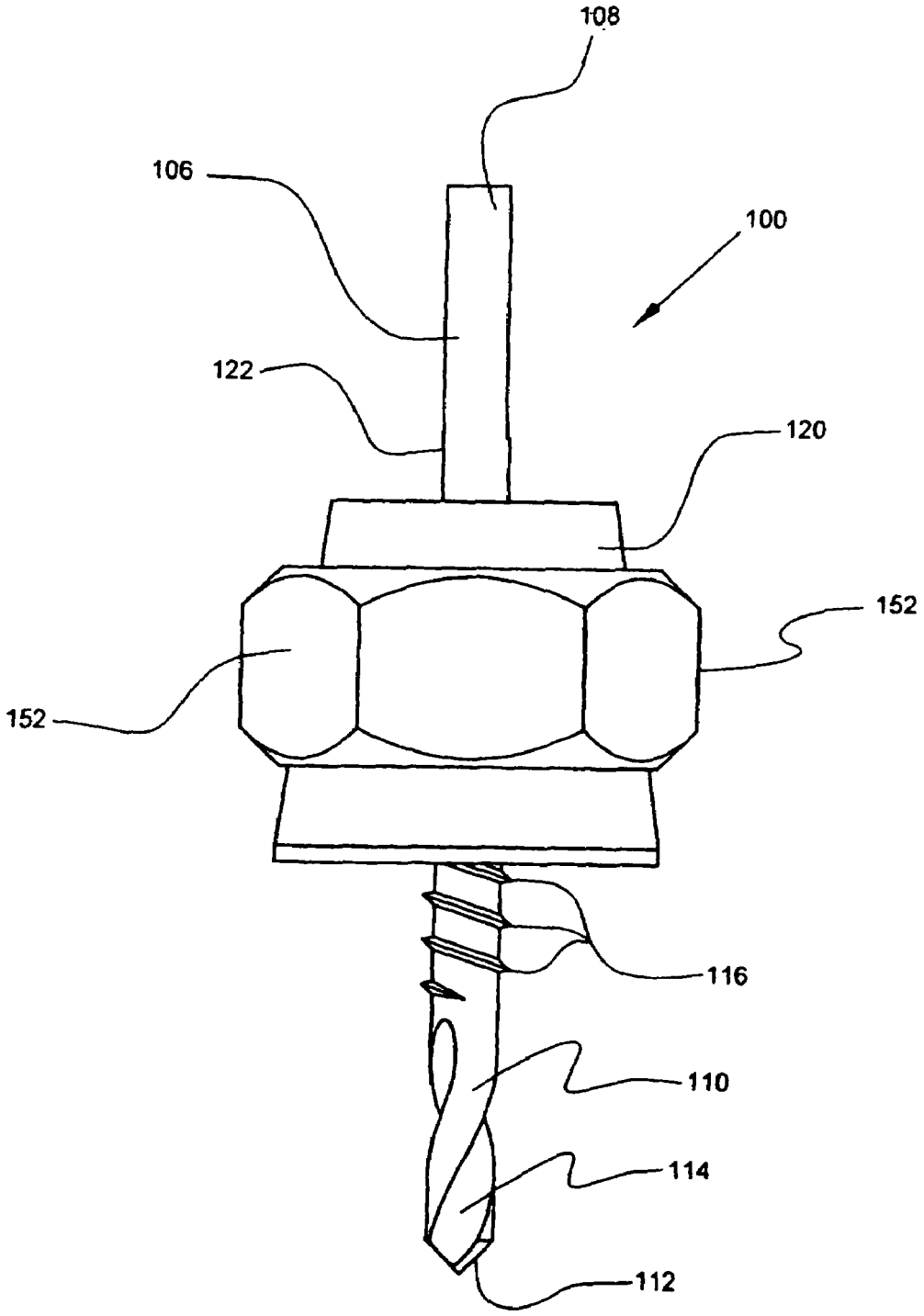
FIG. 11 is a front elevation view of the alternative device of FIG. 10 in accordance with the present invention.
Figure 12:
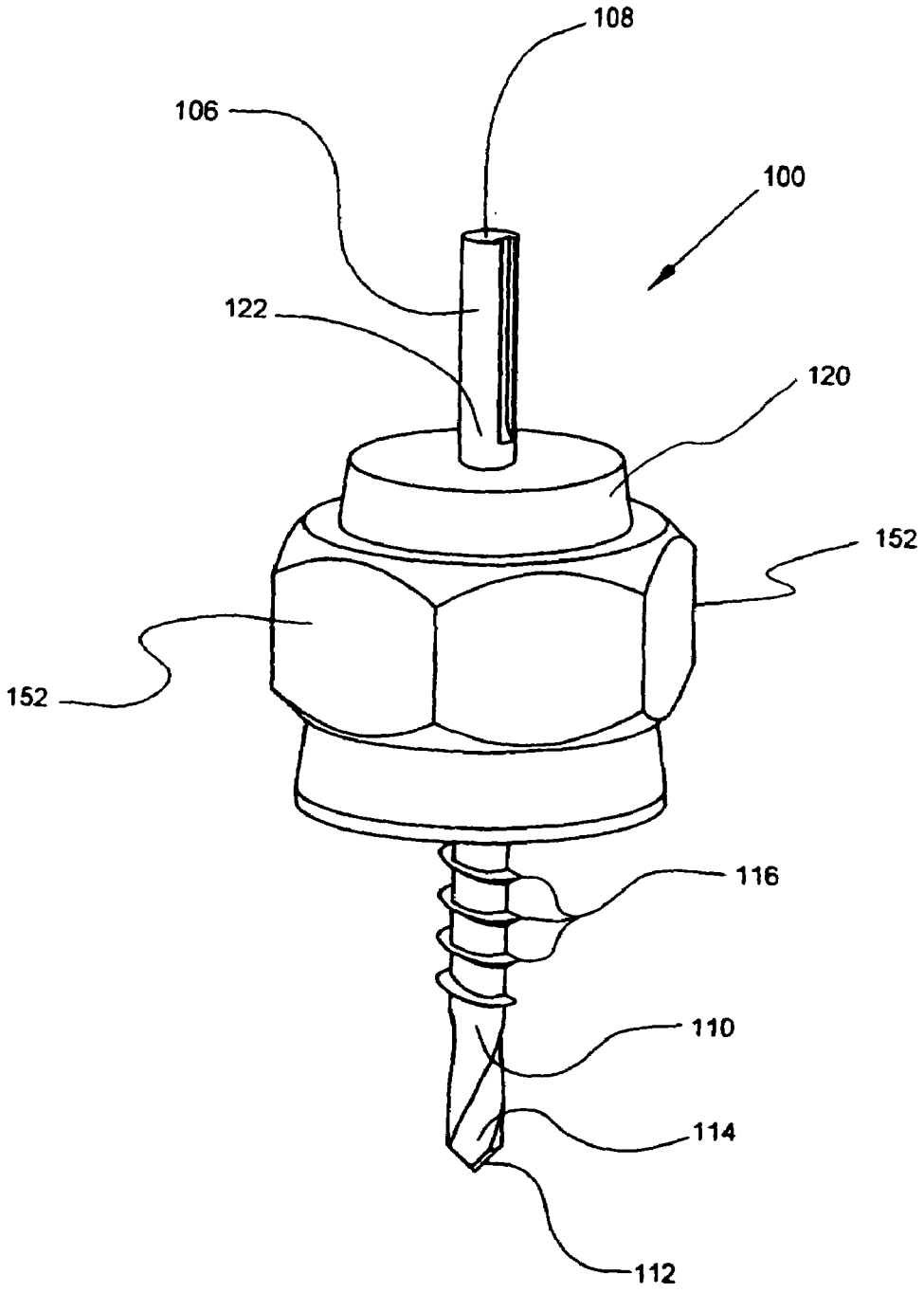
FIG. 12 is a perspective view of the alternative device of FIG. 11.

To prevent the cutting end tool 112 and drill bit portion 114 from penetrating through the fastener 102 and into the workpiece 104 thereby damaging the workpiece 104, a socket 120 is dimensioned and secured to a mid-portion 122 of the shaft 106 between the first end portion 108 and the cutting threads 116 such that the penetration of the cutting end tool 112 into the fastener 102 is limited to a predetermined distance. The socket 120 may be integrally joined to the shaft 106 as depicted in FIG. 5, rotationally secured to the shaft 106 as depicted in FIG. 3A such that rotational force is not transferred from the shaft 106 to the socket 120, or removably secured to the shaft 106 as depicted in FIG. 3B such that rotational force is transferred from the shaft 106 to the socket 120. The socket 120 may include frustoconically configured inner and outer portions 124 and 126 (see FIG. 5), or may include cylindrically configured inner and outer portions 128 and 130 (see FIGS. 6 and 10). A frustoconical configuration allows the inner portion 124 of the socket 120 to "grasp" a frustoconnically configured head 132 of the fastener 102, or a hexagonally configured head 138 of a fastener 140, as the faastener 102 or 140 is extracted from the workpiece 104 thereby increasing rotational extraction force upon the fasteners 102, 140 and maintaining the longitudinal axis 134 of the fasteners 102, 140 perpendicular to the surface of the workpiece 104 thereby preventing the fasteners 102, 140 from damaging the workpiece 104 during extraction. A cylindrical configuration allows cutting threads 136 to be disposed on the inner portion 128 of the socket 120 to correspondingly cut threads into a side edge 154 of the hexagonal head 138 of the fastener 140 (see FIG. 10) thereby increasing rotational extraction force upon the fastener 140 and maintaining the perpendicular extraction of the fastener 140 from the workpiece 104.

The socket 120 includes a rim 142 that ultimately engages a surface portion of the workpiece 104 as the cutting end tool 112 penetrates the fastener 102 and the drill bit portion 114 bores a recess 146 into the fastener 102. As the drill bit portion 114 continues boring perpendicularly into the fastener 102, the cutting threads 116 extending beyond the rim 142 of the socket 12 engage and cut into a substantially cylindrical side wall 148 of the recess 146 such that the shaft 106 cannot be removed from the fastener 102 unless the shaft 106 is rotated opposite the insertion direction of the cutting threads 116. A friction reducing means 150 may be added to the rim 142 to prevent damaging the surface of the workpiece 104 that the rim 142 rotationally engages as the drill bit portion 114 bores the recess 146 into the fastener 102.

When the cutting threads 116 engage the cylindrical side wall 148 of the recess 146, the rotary motion imparted upon the first end portion 108 of the shaft 106 may be insufficient to Continue penetration of the cutting end tool 112 into the fastener 102 while cutting threads into the side wall 148. Further, when the socket rim 142 engages the workpiece 104, the continued rotation of the socket 120 upon the surface of the workpiece 104 may damage the cutting threads 116 that have cut corresponding threads 151 into the recess wall 148, or may score or otherwise damage the wall threads 151 such that the "grasp" of the cutting threads 116 upon the fastener 102 is lost. To overcome these potential problems, a hexagonally configured hand tool receiving portion 152 is formed on the outer frustoconical portion 126 (see FIGS. 11 and 12) or the outer cylindrical portion 130 (see FIG. 10) of the socket 120 to removably receive a manual rotary drive tool capable of rotating the socket 120 irrespective of the gripping force of the workpiece 104 upon the fastener 102. When the socket 120 engages the surface of the workpiece 104 during the penetration of the cutting end tool 112 into the fastener 102, the motorized rotary drive tool is removed and the manual rotary drive tool is positioned upon the receiving portion 152 to "slow down" the rotational speed of the device 100 thereby allowing the cutting threads 116 to grasp and remove the fastener 102 as the device 100 is rotated in a direction contrary to the direction of insertion of the fastener 102 into the workpiece 104, and correspondingly preventing the cutting threads 116 from breaking and/or scoring the wall threads 151 in the cylindrical side wall 148 of the recess 146.

The gripping capability of the manual rotary drive tool upon the receiving portion 152 may be increased by adding a knurled or fluted surface 41 (see FIGS. 4A, 4D and 4E) to the receiving portion 152. To increase the gripping capability of the socket 120 upon the relatively large head 138 of the fastener 140, the socket 120 may include a plurality of ribs 33 (see FIG. 4A) that engage a side wall of the fastener head 138. Also, slits 38 (see FIGS. 4A, 4D and 4E) as detailed above may be utilized in the socket 120 to increase the gripping capability of the socket 120 upon the fastener head irrespective of the configuration of the fastener head.

To increase the gripping capability of the socket 120 upon the surface of the head of the fastener irrespective of the configuration of the head, cutting teeth 19 (see FIGS. 4A and 4B) are disposed upon the rim 142 of the fastener 102, the rim 142 having a diameter that promotes engagement between the rim 142 and the surface of the head of the fastener. When damage to the workpiece 104 is of no concern, the fastener 102 may be removed from the workpiece 104 by providing a rim 142 having cutting teeth 19 and a diameter that disposes the cutting teeth 19 upon the workpiece 104 adjacent to the fastener head. The cutting end tool 112 then penetrates the fastener 102 while the cutting teeth removes portions of the workpiece 104 adjacent to the fastener 102 thereby "freeing" the fastener from the workpiece 104 and simplifying fastener 102 removal.

In operation, a fastener extraction device 100 is rotationally inserted into a fastener 102 that cannot be removed from a workpiece 104 via typical fastener rotational drive tools. The fastener extraction device 100 is selected to penetrate the fastener 102, without engaging the workpiece 104, to a depth that facilitates removal of the fastener 102 from the workpiece 104. A motorized rotary drive tool is removably secured to a first end portion 108 of a shaft 106 to forcibly rotate the device 100 in a direction opposite to the direction of insertion of the fastener 102 into the workpiece 104. The device 100 includes a cutting end tool 112 that penetrates the fastener 102 while a drill bit portion 114 bores a recess 146 into the fastener 102 the required depth, and cutting threads 116 that cut into a side wall 148 of the recess 146 until the device 100 is rigidly secured to the fastener 102. As the cutting end tool 112, drill bit portion 114 and cutting threads 116 are forcibly inserted into the fastener 102 in a rotational direction contrary to the fastener's insertion direction into the workpiece 104, the fastener 102 may "break free" from the grasp of the workpiece 104 and start rotating outwardly from the workpiece 104.

Generally, the fastener 102 will not break free from the workpiece 104 while the motorized rotary drive tool rotates the device. Further, the continued operation of the motorized rotary drive tool will excessively insert the cutting end tool 112 into the fastener 102 and damage the workpiece 104. To limit the insertion depth of the cutting end tool 112 into the fastener 102 and promote removal of the fastener 102 from the workpiece 104, a socket 120 is secured to the shaft 106 such that a predetermined quantity of cutting threads 116 extend beyond a rim 142 of the socket 120 thereby allowing the cutting threads 116 to rotationally engage the wall of the recess 146 and secure the device 100 to the fastener 102, while limiting the insertion depth of the device 100 into the fastener 102 via the socket rim 142 engaging the surface of the workpiece 104. When the socket rim 142 engages the workpiece 104, the motorized rotary drive tool is removed and a hand tool, capable of imparting sufficient rotary motion to facilitate the removal of the fastener 102 from the workpiece 104, is removably secured to a tool receiving portion 152 of the socket 120. An individual then forcibly rotates the socket 120 in the same direction that the cutting end tool 112 was inserted into the fastener 102, which is opposite the rotary direction of insertion of the fastener 102 into the workpiece 104, thereby forcibly extracting the fastener 102 from the workpiece 104.

The foregoing description is for purposes of illustration only and is not intended to limit the scope of protection accorded this invention. The present invention may be presented in other specific embodiments without departing from the essential attributes of the present invention. It is apparent that many modifications, substitutions, and additions may be made to the preferred embodiment while remaining within the scope of the appended claims, which should be interpreted as broadly as possible.

The invention claimed is:

1. A device to extract a fastener from a workpiece wherein the fastener has a predetermined direction of insertion into the workpiece, the device comprising:

a shaft having first end and second end portions, said first end portion adapted to be received by a tool for imparting torque contrary to the fastener's direction of engagement, said tool providing rotary motion sufficient to bore a recess in the fastener, said second end portion terminated in a cutting tool adapted to engage the fastener as said shaft is rotated, said shaft rotation being contrary to the fastener's direction of engagement;

a drill-bit proximal to the cutting tool and adapted to engage and bore into the fastener as said shaft is rotated;

a socket having a rim, longitudinally extending slits, an outer surface with a threaded section and an adjustable inner diameter, wherein a height of the thread's protrusion above the outer surface increases the closer the thread is to the rim of the socket, wherein said socket is joined to said shaft such that rotary motion is transferred from said shaft to said socket;

a collar collet disposed on the threaded section of the socket wherein upon a rotation of the collar collet the adjustable inner diameter of the socket is altered via said thread's protrusion and said slits; and cutting threads disposed upon said shaft between said socket and said drill-bit such that said cutting threads penetrate, via rotary motion imparted upon said socket, a recess wall formed in the fastener by said drill-bit, said cutting threads penetrating said recess wall a predetermined distance to form and be secured to corresponding threads cut by said cutting threads in said recess wall, while said cutting tool bores into the fastener pursuant to the rotary motion imparted upon said socket until said socket engages the workpiece, whereby said cutting threads secure said shaft to the fastener and promote the removal of the fastener from the workpiece when the socket engages the workpiece and the rotation of said shaft is contrary to the fastener's insertion direction into the workpiece.

2. The device of claim 1 wherein said socket is secured to a portion of said shaft between said first end portion and said cutting threads.

3. The device of claim 2 wherein said socket comprises means to cut threads into a head of the fastener.

4. The device of claim 2 wherein said rim ultimately engages a surface portion of the workpiece.

5. The device of claim 4 wherein said rim comprises means to reduce friction between said rim and said surface portion of the workpiece.

6. The device of claim 4 wherein said socket is configured such that said cutting threads extend beyond said rim thereby promoting penetration of said cutting threads into the fastener.

7. The device of claim 2 wherein said socket includes a frustoconically configured inner portion.

8. The device of claim 2 wherein said socket includes a cylindrically configured outer portion.

9. The device of claim 2 wherein said socket includes an inner portion with cutting threads for grasping a head of the fastener to promote the extraction of the fastener from the workpiece.

10. The device of claim 2 wherein said socket is integrally joined to said shaft.

11. The device of claim 2 wherein said socket is removably secured to said shaft such that rotary motion is transferred from said shaft to said socket.

12. The device of claim 11 wherein said socket includes a hexagonally configured aperture that removably receives a hexagonally configured portion of said shaft.

13. The device of claim 2 wherein said socket includes means for gripping the fastener.

14. The device of claim 13 wherein said gripping means includes a plurality of ribs that ultimately engage a side wall of a head of the fastener.

15. The device of claim 13 wherein said gripping means includes cutting teeth disposed upon a rim of said socket, said rim having a diameter that promotes engagement between said rim and a head of the fastener.

16. The device of claim 13 wherein said socket includes slits.

17. The device of claim 2 wherein said socket is dimensioned to limit the penetration of said cutting tool into the fastener whereby the workpiece is not damaged by said cutting tool.

18. The device of claim 2 wherein said socket includes means for cutting the workpiece adjacent to the fastener.

19. The device of claim 18 wherein said cutting means includes cutting teeth disposed upon said rim, said rim having a diameter that promotes engagement between said rim and the workpiece adjacent to the fastener.

20. The device of claim 1 wherein said drill bit defines a region along a longitudinally extending section of said shaft between said cutting threads and said cutting tool.

21. A device for extracting a fastener from a workpiece comprising:

a shaft having first and second portions, said first portion adapted to receive rotary motion provided by a rotary motion tool, said second portion terminated in a cutting tool adapted to engage the fastener as said shaft is rotated, said second portion having a drill bit portion adjacent to said cutting tool, said drill bit portion being adapted to bore a recess in a fastener;

a thread cutting portion that engages and cuts threads into a wall of said recess bored in the fastener via said drill bit portion penetrating the fastener;

a socket having a rim, longitudinally extending slits, an outer surface with a threaded section and an adjustable inner diameter, wherein a height of the thread's protrusion above the outer surface increases the closer the thread is to the rim of the socket, wherein said socket is joined to said shaft such that rotary motion is transferred from said shaft to said socket;

a collar collet disposed on the threaded section of the socket wherein upon a rotation of the collar collet the adjustable inner diameter of the socket is altered via said thread's protrusion and said slits; and said first portion providing a rotational speed to said shaft, whereby cutting threads of said thread cutting portion cut threads into said wall of said recess to secure said shaft to the fastener while said cutting tool and said drill bit portion promote insertion of said shaft into the fastener, thereby promoting the removal of the fastener from a workpiece when said cutting tool engages the workpiece and said shaft rotation is contrary to the fastener's insertion direction into the workpiece to ultimately extract the fastener from the workpiece.

22. The device of claim 21 wherein said socket is secured to said shaft such that said thread cutting portion extends beyond said rim.

23. A method for extracting a fastener from a workpiece, said method comprising the steps of:

providing a shaft having a first portion adapted to receive rotary motion, said shaft having a second portion that includes a cutting end tool, a drill bit portion disposed adjacent to said cutting end tool for penetrating a fastener, and a cutting portion disposed between said drill bit portion and said first portion, said cutting portion ultimately securing said shaft to the fastener via cutting threads rotationally urged into a recess wall of a recess bored by said drill bit portion;

providing a socket having a rim, longitudinally extending slits, an outer surface with a threaded section and an adjustable inner diameter, wherein a height of the thread's protrusion above the outer surface increases the closer the thread is to the rim of the socket, wherein said socket is joined to said shaft such that rotary motion is transferred from said shaft to said socket;

providing a collar collet disposed on the threaded section of the socket wherein upon a rotation of the collar collet the adjustable inner diameter of the socket changes via said thread's protrusion and said slits;

providing a tool for imparting rotary motion upon said first portion of said shaft until said cutting tool and said drill bit cooperatively penetrate the fastener a predetermined distance;

imparting relatively slow rotary motion upon said shaft; and limiting the penetration of said drill bit into the fastener, whereby the fastener is ultimately extracted from a workpiece by forcibly rotating said shaft in a direction opposite the direction of rotational insertion of the fastener into the workpiece.

24. The method of claim 23 wherein the step of imparting relatively slow rotary motion upon said shaft includes the step of securing the socket to said shaft such that said cutting portion extends beyond said rim, thereby promoting rotational insertion of said cutting portion into a recess in the fastener formed by said drill bit penetrating the fastener, whereby the fastener is ultimately extracted from the workpiece by forcibly rotating said socket in a direction opposite the direction of rotational insertion of the fastener into the workpiece.

* * * * *